US005485795A

United States Patent [19]

Williams

[11] Patent Number: 5,485,795

[45] Date of Patent: Jan. 23, 1996

[54] FREE STANDING EXTENSION TABLE AND METHOD OF MANUFACTURE

[76] Inventor: Jeanne L. Williams, 332 So. Gill St., State College, Pa. 16801

[21] Appl. No.: 412,947

[22] Filed: Mar. 29, 1995

[51] Int. Cl.[6] ..... A47B 1/04

[52] U.S. Cl. ..... 108/69; 108/66; 108/64

[58] Field of Search ..... 108/69, 64, 66, 108/65

[56] References Cited

U.S. PATENT DOCUMENTS

| | | | |
|---|---|---|---|
| 2,297,647 | 9/1942 | Chason . | |
| 2,492,139 | 12/1949 | Eliason . | |
| 2,705,179 | 3/1955 | Hodgin . | |
| 3,053,598 | 9/1962 | Cheslow | 108/64 |
| 3,437,390 | 4/1969 | Evans . | |
| 3,714,906 | 2/1973 | Finestone | 108/64 |
| 4,646,654 | 3/1987 | Sullivan | 108/66 X |
| 4,750,432 | 6/1988 | McNamara et al. | 108/69 |
| 4,815,393 | 3/1989 | Pollak | 108/69 |
| 5,146,855 | 9/1992 | Morgan | 108/66 X |
| 5,341,750 | 8/1994 | Fuchs | 108/66 X |
| 5,373,794 | 12/1994 | Wiberg . | |

FOREIGN PATENT DOCUMENTS

| | | | |
|---|---|---|---|
| 2232179 | 12/1974 | France | 108/66 |
| 282884 | 10/1912 | Germany | 108/66 |

*Primary Examiner*—Jose V. Chen

*Attorney, Agent, or Firm*—Diller, Ramik & Wight

[57] ABSTRACT

A self-supporting extension table is defined by a main table portion having a recess at one end, an edge opposite thereto, and a drop leaf adjacent the latter edge with the drop leaf corresponding in shape and configuration to the recess. The drop leaf is formed from the material removed from the recess which provides ease of manufacture at a low cost generally absent waste material.

20 Claims, 2 Drawing Sheets

30
26
28
23
21
25
27
24
22
22
22
20
49
47
43
46
41
44
45
48
55
57
56
40
42
50
42
42
10

50
55
60
10
64
57
64
60
62
42
48
63
61
60
62
62
61
63
62
46
42
42
47
49
42

FREE STANDING EXTENSION TABLE AND METHOD OF MANUFACTURE

BACKGROUND OF THE INVENTION

The invention is directed to a novel free standing extension table utilized in conjunction with a conventional table, such as a dining room or kitchen table, to increase the seating capacity as is desirable at times, most notable during holidays, such as Thanksgiving, Christmas or the like.

Typical dining room tables might conveniently seat eight to twelve persons and perhaps more, but on occasion the diners outnumber the seating capacity. It is not uncommon under such circumstances to set-up a card table and place it end-to-end with the dining room table. Rarely if ever is the card table of the same width or height as the dining room table, and most often the perimeter contour of the card table and the dining room table differ considerably from each other. Most often than not, the table tops are therefore not aligned and gaps exist at adjacent corners of the contiguous tables. These corners define gaps or voids which when covered by a tablecloth are not apparent, and should a person place an object thereover, the object might well fall to the floor since it is unsupported from beneath. Card tables can be unstable and at times individuals have attempted to level the top of the card table with the top of a dining room table by placing books or similar objects under the legs of the card table. Needless to say, disaster has ofttimes occurred through inadvertent/accidental dislodgement of the leg-supporting objects of the card table. This approach is of questionable merit, as are other "homemade" solutions, such as constructing knock-down tables from relatively rough lumber forming a table top and pipes forming legs which are threaded into pipe fittings secured to the underside of the wooden table top.

Some more sophisticated approaches to solving the problem of seating capacity involves the utilization of table leafs or drop leafs. However, the use of leafs and drop leafs will eventually extend the seating table to a maximum, but not beyond. Accordingly, it is desirable to provide a table extension beyond the norm achieved heretofore in any known conventional manner.

A search of the subject matter of the present invention uncovered a number of patents dealing with table extensions, such as U.S. Pat. No. 2,297,647 in the name of Daniel H. Chason which issued on Sep. 29, 1942. In this patent a conventional table includes a table top of a general polygonal configuration supported by four dependent legs with one leg being located at each corner. The table extension includes a planar table top and two legs remote from an opposite edge which is connected by a special and complicated bracket to the first-mentioned table. The extension table is not per se self supporting, but does achieve a uniformity of table top height.

Another furniture extension mechanism is disclosed in U.S. Pat. No. 5,373,794 in the name of Ole Wiberg granted on Dec. 20, 1994. In this case an upper supporting surface is hinged to a main table or the like, and opposite the hinge includes a pair of folding legs.

In U.S. Pat. No. 5,241,750 issued to Mike M. Fuchs on Aug. 30, 1994 an extendable table is provided in the form of a self-supporting table leaf having a pair of oppositely opening curved recesses which accommodate portions of circular table tops. The table tops and leaf or table extension utilize removable legs which facilitate the individual self support of the table tops or the collective support of the circular table tops and the associated extension.

U.S. Pat. No. 3,437,390 issued to Royce F. Evans on Apr. 8, 1969 discloses a generally main pedestal table having an octagonal table top to which can be secured in edge-to-edge contact a number of dolleys which extend all table surfaces in a common plane and permit the units to be moved in unison.

U.S. Pat. No. 2,705,179 in the name of Charles L. Hodgin issued on Mar. 29, 1995 discloses a pair of relatively detachable tables in which a main table has four pivotal legs and an auxiliary table has two pivoted legs and is itself pivoted to the main table in order that the auxiliary table can be oriented in different positions relative to the main table. Such extension tables can be added to each other to extend the main table ad infinitum. The complexity of the structures are apparent from the drawings and the description relative thereto.

SUMMARY OF THE INVENTION

In keeping with the foregoing, the present invention provides a relatively simple and straightforward self-supporting extension table which is relatively easy to manufacture, can be manufactured quite inexpensively in virtually the absence of waste material, and when associated with a conventional dining room table, can extend the seating thereof with relative ease. Moreover, when the dining room table and the extension table are covered by a tablecloth, there is no hint of the use of the extension table, and the overall contour or configuration of the combined tables provides the appearance of a single symmetrical table.

The free standing extension table is preferably custom made from wood, although synthetic materials can be utilized. The extension table is initially of a generally polygonal, rectangular or square configuration and one end thereof is cut to match the peripheral edge of an existing table top of a dining room table with which the extension table is to be associated. When thus cut the extension table top is provided with a recess defined by a recess cut edge which matches the perimeter edge of the dining room table and additionally provides a table top portion which has a projecting edge corresponding in shape and configuration to the recess edge which also matches the perimeter edge of the dining room table. This projecting portion is hinged to a terminal edge of the extension table remote from the recess edge and can be utilized as a further extension of the overall table extension or as a drop leaf when hinged to a nonuse or vertical position. However, when the projecting drop leaf portion is in a horizontal position, its configuration matches the configuration of the dining room table, and when both are united perimeter edge-to-recess edge and covered by a tablecloth, the outward appearance is that of a single table with a uniform stable table top of symmetrical appearance.

With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENT

Figure 1:
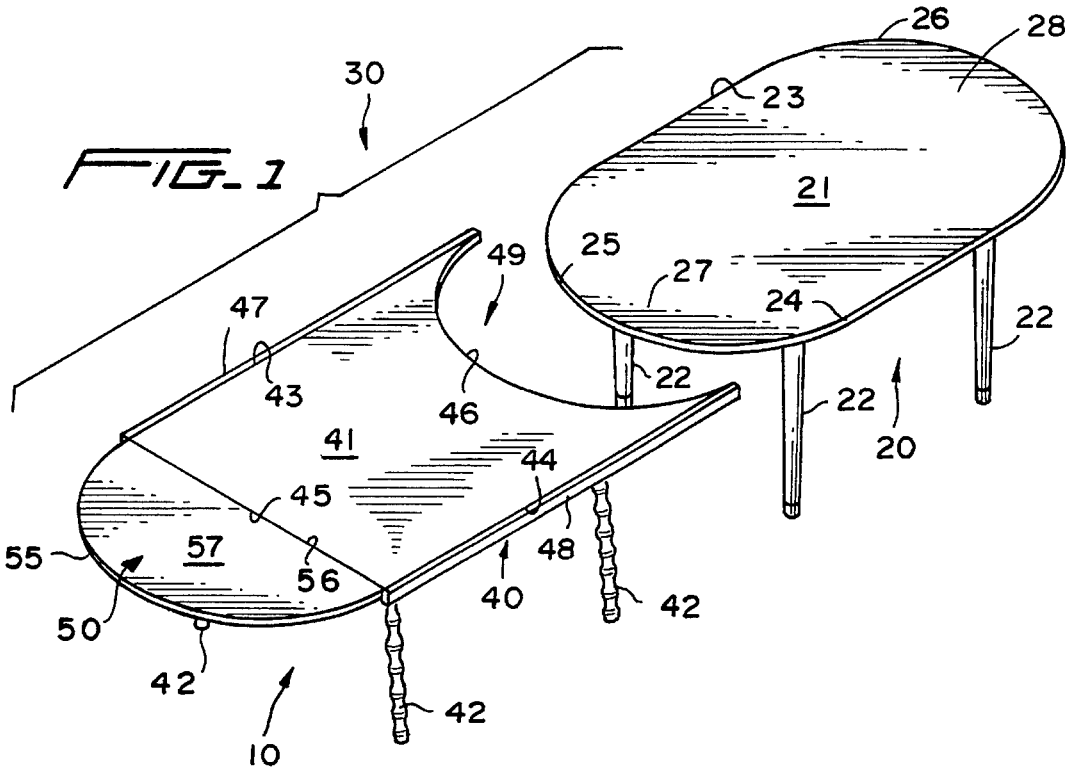
FIG. 1 is a perspective view and illustrates a self-supporting extension table of the present invention associated with a conventional dining room table with the extension table having a recess conforming to the configuration of an edge portion of the dining room table, and an outwardly directed drop leaf projection also having an edge contoured to the configuration of the recess edge and peripheral edge of the respective recess and dining room table periphery.
Figure 2:
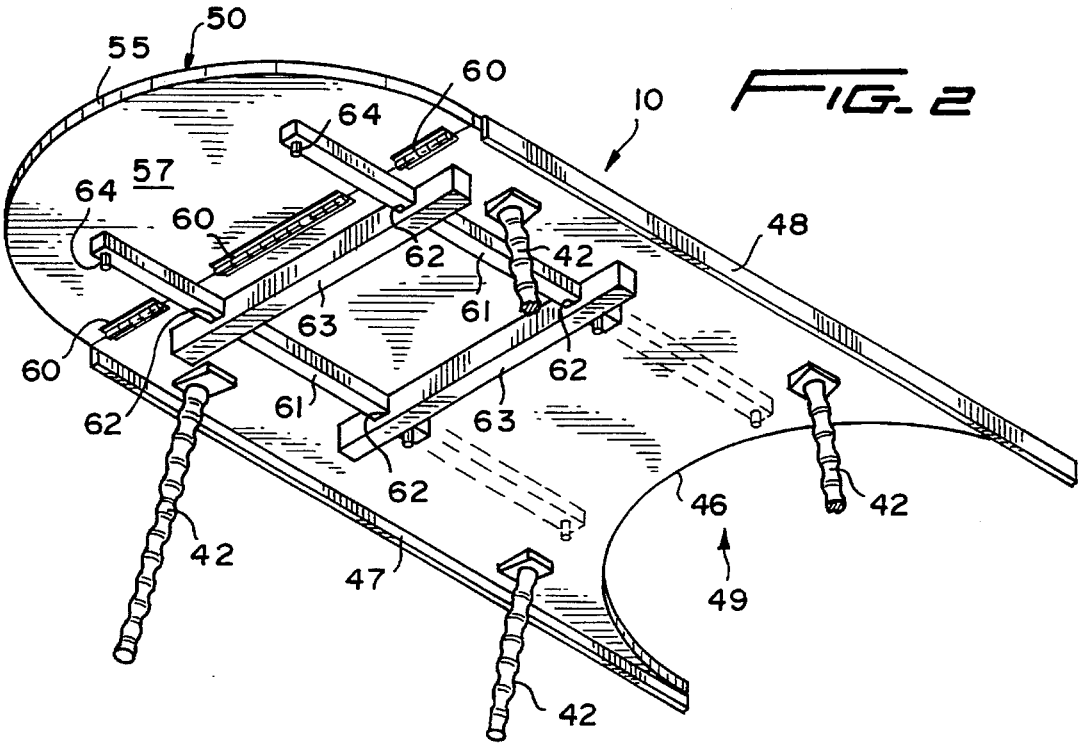
FIG. 2 is a fragmentary bottom perspective view, and illustrates four removable legs associated with the extension table, a hinge mechanism, and a mechanism for maintaining the projecting drop leaf portion in a generally horizontal plane.

A novel free standing or self-supporting extension table constructed in accordance with this invention is fully illustrated in FIGS. 1 and 2 of the drawings and is generally designated by the reference numeral 10. The extension table 10 is illustrated in FIG. 1 associated with a conventional table 20 which may, for example, be a dining room table, a kitchen table, a main table or the like. The extension table 10 and the dining room table 20 define a cooperative overall combination which is generally designated by the reference numeral 30 in FIG. 1.

The dining room or main table 20 includes a table top 21 which is preferably, though not necessarily, constructed of wood and includes a plurality of legs 22 which support the table top 21 a predetermined distance above a horizontal surface (not shown) in a conventional manner. The table top 21 is generally of an oval-shaped configuration defined by opposite generally parallel side peripheral edges 23, 24 and opposite convex peripheral edges 25, 26 of identical curvature each defining respective projecting edge or end portions 27, 28. The seating capacity of the table 20 can vary anywhere from four, six or eight persons to up to ten, twelve persons or beyond. Irrespective of the total seating capacity, as was earlier noted herein, an increase in seating capacity is desirable, hence the purpose of the extension table 10. The extension table 10 is preferably constructed from wood and is manufactured in a manner which will be described more fully hereinafter with respect to FIGS. 3–5 of the drawings. However, the particular material from which the extension table 10 is constructed can vary and can include many known conventional synthetic materials and Laminates.

The extension table 10 includes a main or major table portion 40 defined by a table top 41 having opposite generally parallel side edges 43, 44 and opposite end edges 45, 46. The edges 43, 44 are spaced from each other a distance corresponding generally to the distance between the edges 23, 24 of the table top 21. Wooden reinforcing rails 47, 48 are conventionally bonded or fastened to the respective edges 4B, 44 of the extension table top 41 to rigidify and strengthen the same. Four identical legs 42 are removably threaded to the underside (FIG. 2) of the table top 41 in a conventional manner, and the length thereof is such that an upper surface (unnumbered) of the extension table top 41 is flush with an upper surface (unnumbered) of the table top 21 of the table 20 when the two tables are positioned adjacent each other with either of the edge portions 27, 28 of the table top 21 nested in a recess 49 of the table top 41 defined by the end edge 46, as is clearly apparent from FIG. 1 and is fully illustrated in FIG. 5 of the drawings. Since the peripheral edges 25, 26 of the table top 21 are identical, the edge portion 28 of the table top 21 could as well be nested within the recess 50 of the extension table top 41. Just as obvious is the fact that an additional extension table duplicating the extension table 10 could be mated with the edge portion 28 of the table top 21, and in this arrangement the dining room table 20 would be essentially sandwiched between two of the extension tables 10 thereby doubling the seating capacity provided by a single one of the extension tables 10.

The extension table 10 includes another table portion 50 in the form of an outwardly directed projection or drop leaf defined by a generally curved or arcuate projection edge 55 which at opposite ends (unnumbered) merges with a remote terminal edge 56. When the projecting portion or drop leaf 50 is disposed in a horizontal plane, as shown in FIGS. 1 and 2, a top 57 thereof is coplanar to the table top 41 of the extension table 10 and the table top 21 of the dining room table 20.

The drop leaf or outwardly directed projection 50 is hinged by hinge means 60 (FIG. 2), such as conventional piano hinges, secured by conventional fasteners (not shown) to the edges 45, 46 of the tops 41, 57, respectively.

A pair of top supporting slides 61, 61 (FIG. 2) are slidably supported in aligned grooves 62 formed in spaced parallel blocks 63, 63 conventionally fastened and/or glued to the underside of the table top 41. Each top supporting slide 61 carries downwardly directed projections 64, 65 at opposite ends thereof which contact selected ones of the blocks 63 when the slides 61 are moved between the solid and phantom outline positions thereof shown in FIG. 2. In the solid outline position, the top 57 is underlyingly supported by the slides 61 and the top 57 of the drop leaf projection 50 is coplanar to the table top 41 of the table portion 40. However, when the slides 61 are moved to the phantom outline position shown in FIG. 2, the drop leaf projection 50 occupies a vertical plane, as is readily apparent from FIGS. 1 and 2 of the drawings.

Figure 4:
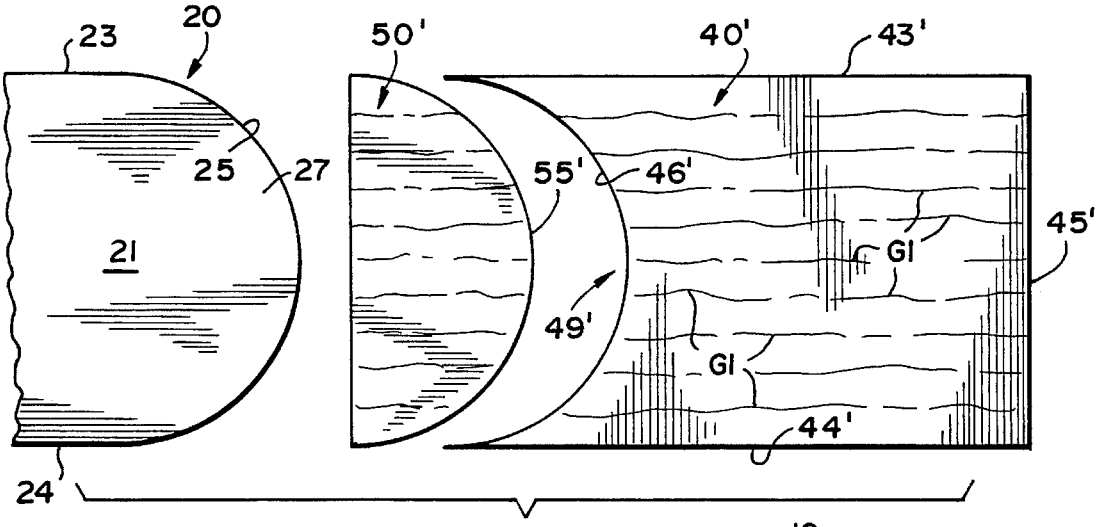
FIG. 4 is a top plan view, and illustrates the polygonal panel being cut into a main portion having a recess and a chordal portion with the arcuate cut edge of each corresponding to each other and to peripheral edge of the dining room table top.
Figure 5:
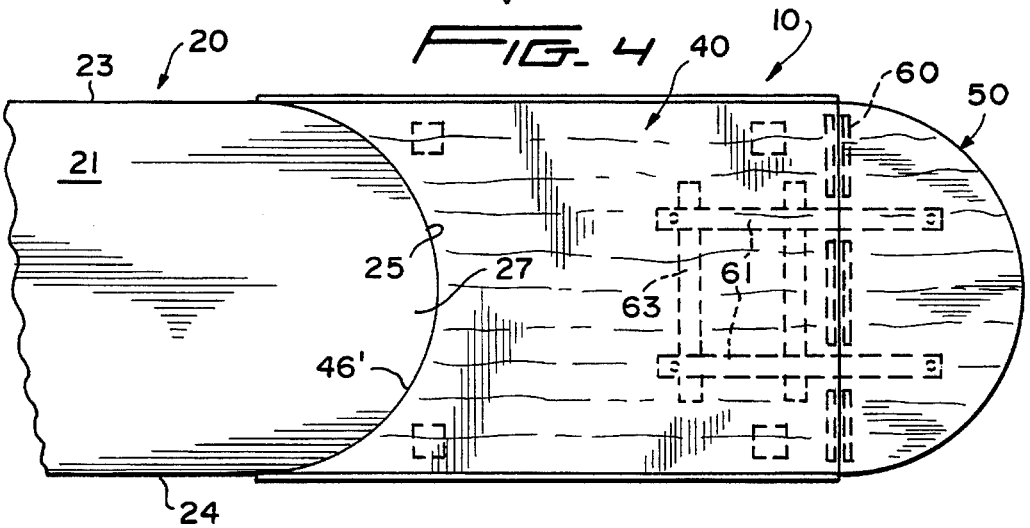
FIG. 5 is a top perspective view, and illustrates the peripheral edge of the dining room table top mating precisely with the recess edge of the main portion recess and the chordal portion being hinged to the main portion which in the horizontal position thereof imparts a curvature to the extension table corresponding to that of the dining room table top curvature.

When the extension table 10 is set-up or erected with the drop leaf projection 50 in the position shown in FIGS. 1 and 2 and with the edge portion 27 of the table top 21 housed within the recess 49, as shown in FIG. 4, opposite ends of the overall combination 30 are of the same top plan profile or configuration because, of course, the edges 26, 55 are of the same curvature. Accordingly, when a table cloth is placed on top of the tops 21, 41, 57, the mated combination 30 of FIG. 1, the overall shape is essentially entirely symmetrical and there is no outward evidence of the existence of the extension table 10, and diners sitting at the covered combination 30 are essentially unaware of the two-piece (10, 20) construction. It might be noted that the reinforcing strips 47, 48 do project laterally outwardly slightly beyond the edges 23, 24 of the table top 21, but this is a relatively minor projection and can be totally eliminated by reducing the distance between the edges 43, 44 such that the distance between the outer surfaces of the reinforcing members 47, 48 is identical to the distance between the edges 23, 24 of the table top 21. Alternatively, the reinforcing members 47, 48 can be positioned beneath and totally inboard the edges 43, 44, and in the latter two cases the edges 23, 24 will align perfectly with either the outer edges of the members 47, 48 or the outer edges 43, 44. In all of these cases, once the combination 30 has been united and covered by a table cloth, the overall appearance is that of a single covered relatively long dining room table capable of accommodating as many diners as may be desired. However, even the latter can be extended once again, as was earlier noted, by utilizing an extension table 10 at both edge portions 27, 28 of the table 20.

The extension table 10 is manufacture in accordance with a novel process which virtually assures the absence of waste material and a relatively aesthetic appearance, particularly when the extension table 10 is manufacture from wood.

In accordance with the novel method of the invention, a generally polygonal panel 70 (FIG. 3) is first provided which include generally parallel longitudinal edges 43', 44' and generally parallel transverse or end edges 45', 56'. Though the polygonal panel 70 is preferably constructed from wood which is relatively strong, straight, square and planar, it might also be constructed from synthetic materials which are normally laminated and might include a faux wood grain decorative appearance. However, whether wood or faux wood, grain G thereof will preferably run longitudinally, as is evidenced by a number of irregular though somewhat parallel grain lines Gl extending between the transverse edges 45', 56'. Lengthwise or longitudinal grain lines G1 are preferable because the transverse members 63, 63 (FIG. 2) secured to the underside of the table top 41 are generally normal to such grain lines G1 and additionally function to impart transverse rigidity to the table top 41.

The panel 70 is positioned above or below, the latter being illustrated in FIG. 3, the table top 21 of the table 20 which is to be extended upon the custom manufacture of the table extension 10. When thus positioned the edges 23, 43' and 24, 44' are in alignment and the transverse edge 56' is normal to the edges 23, 24 at a point (unnumbered) at which these edges merge with the ends of the peripheral edge 25 of the table top 21. A line L is marked or scribed upon the surface (unnumbered) of the panel 70 by moving a scribe, pencil or like along the perimeter edge 25 of the table top 21. Thus the line L has a curvature or contour identical to the peripheral edge 25, as well as the peripheral edge 26.

The panel 70 is then carefully cut along the scribe line L which defines a major or main panel portion 40' and a minor or chordal panel portion 50'. By cutting along the scribe line L the main portion 40' has a contoured curved cut edge 46' defining a recess 49', while the minor chordal portion 50' includes a like contoured projection edge 55' opposite and remote from the edge 56'.

Figure 3:
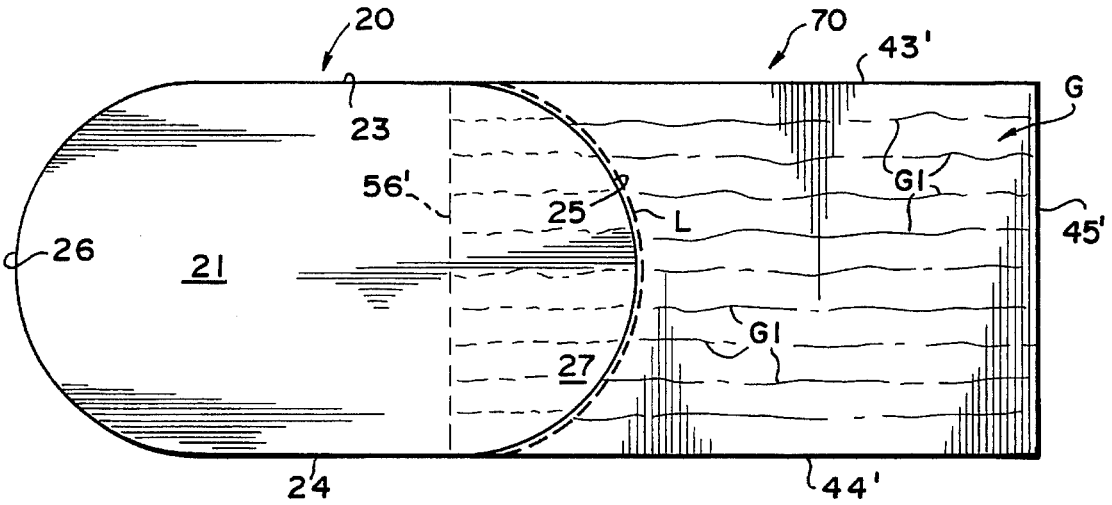
FIG. 3 is a top plan view, and illustrates the dining room table top of FIG. 1 beneath which lies an end portion of a polygonal wood panel which has been marked or scribed along an arc corresponding/to a peripheral edge of the dining room table top.

As will be apparent from a comparison of FIGS. 3 and 4, and FIG. 1, the reference numerals utilized in FIGS. 3 and 4 correspond to the same reference numerals in FIG. 1, except primed. From the latter it is relatively apparent that the main panel portion 40' becomes the table portion 40 with the respective recesses 49', 49 thereof, whereas the chordal portion or panel 50' defines the projecting table portion or drop leaf panel 50.

In order to unite the two panels or panel portions 40', 50', the chordal panel portion 50' is simply positioned with its edge 56' contiguous the edge 45' of the main panel portion 40' and the hinges 60 are attached thereto. Since the chordal panel portion 50' is constructed from the same panel or material 70 as the main panel portion 40', there is a similarity in wood tone and grain lines, and though the grain lines will not perfectly align themselves, the appearance will be of substantial uniformity and will be aesthetically appealing should the extension table 10 be utilized absent a table cloth, pad or similar covering, as is readily apparent from the generally aligned grain lines G1 in FIG. 4 adjacent the edges 45', 56' of the respective panels 40', 50'.

After the hinges 60 have been installed, the legs 42, members 63 and slides 61 are united in a conventional manner as was heretofore described and is readily apparent from FIG. 2 with the reinforcing members 47, 48 being located against the respective edges 43, 44 or therebeneath to complete the construction of the extension table 10. The intimate matching relationship between portions 27, 28 of the table top 21 of the dining room table 20 and the extension table recess 49 is shown in FIG. 4, noting in particular that the perimeter edge 25 of the table top 21 is in intimate engagement with the recess edge 46 of the table top 41. Thus the table top extension is constructed virtually absent any loss of material, particularly in forming the table top 41 and the drop leaf 57 from the panel 70 in the manner just described.

The extension table can be stored quite compactly by simply removing the legs 42 and pivoting the drop leaf 50 about the hinges 60 into overlying relationship to the table top 41. Conventional piano hinges 60 allow such 270° pivoting, namely, between the vertical position of the drop leaf 57 and the position thereof overlying the table top 41.

Although a preferred embodiment of the invention has been specifically illustrated and described herein, it is to be understood that minor variations may be made in the apparatus without departing from the spirit and scope of the invention, as defined in the appended claims.

I claim:

1. A table comprising a table top, said table top being generally planar and including diametrically opposite table top portions, a first of said diametrically opposite table top portions including an outwardly opening recess, a second of said diametrically opposite table top portions defining an outwardly directed projection, said table second top portion being defined by a part of said table top removed from said table first top portion to define said projection and form said recess, said recess and said projection each including an edge configuration defined by a respective recess edge and a projection edge, said recess edge and projection edge are substantially of the same contour, and hinge means for hinging said projection to said first table top portion along an edge remote from said recess edge.

2. The table as defined in claim 1 wherein said recess and said projection each have a maximum respective depth and length which are substantially equal.

3. The table as defined in claim 1 wherein said recess edge and said projection edge are each curved.

4. The table as defined in claim 1 wherein said recess edge and said projection edge are each symmetrically curved.

5. The table as defined in claim 1 wherein said recess edge and said projection edge are each arcuately curved.

6. The table as defined in claim 1 wherein said recess edge and said projection edge are each symmetrically arcuately curved.

7. The table as defined in claim 1 wherein said table top is wood having a predetermined grain pattern, and the grain pattern along said recess edge substantially matches the grain pattern along said projection edge.

8. The table as defined in claim 1 including leg means for self-supporting said table top.

9. A table and extension table combination comprising a table having a table top including an edge portion of a predetermined contour defined by a perimeter edge, said extension table having a table top, said extension table top having diametrically opposite extension table top portions, a first of said diametrically opposite extension table top portions including an outwardly opening recess, a second of said diametrically opposite extension table top portions defining an outwardly directed projection, said extension table second top portion being defined by a part of said extension table top removed from said extension table first top portion to define said projection and form said recess, said recess and said projection each include an edge configuration defined by a respective recess edge and a projection edge; said recess edge projection edge and perimeter edge being substantially of the same contour, and hinge means for hinging said projection to said extension table top second top portion along an edge thereof remote from said recess edge.

10. The table and extension table combination as defined in claim 9 wherein said table top edge portion is nested in said recess with said respective perimeter edge and recess edge being in contiguous relationship to each other.

11. The table and extension table combination as defined in claim 10 wherein said recess and said projection each have a maximum respective depth and length which are substantially equal.

12. The table and extension table combination as defined in claim 10 wherein said recess edge and said projection edge are each curved.

13. The table and extension table combination as defined in claim 10 wherein said recess edge and said projection edge are each symmetrically curved.

14. The table and extension table combination as defined in claim 10 wherein said recess edge and said projection edge are each arcuately curved.

15. The table and extension table combination as defined in claim 10 wherein said recess edge and said projection edge are each symmetrically arcuately curved.

16. The table and extension table combination as defined in claim 10 wherein said extension table top is wood having a predetermined pattern, and the grain pattern along said recess edge substantially matches the grain pattern along said projection edge.

17. The table and extension table combination as defined in claim 10 including means for self-supporting said extension table top.

18. A method of manufacturing an extension table top comprising the steps of providing a relatively planar sheet of material having generally diametrically opposite table top portions, cutting a first of the diametrically opposite table top portions along a line matching a perimeter portion of an existing table to form an outwardly opening recess and a separate top portion set-off in part by a respective recess-defining cut edge and a projecting-portion-defining edge of the separate top portion, and hinging an edge of the separate top portion remote from the projecting-portion-defining edge to a terminal edge of a second of the diametrically opposite table top portions remote from the recess-defining cut edge.

19. The extension table top manufacturing method as defined in claim 18 wherein the planar sheet of material is substantially polygonal.

20. The extension table top manufacturing method as defined in claim 18 wherein the planar sheet of material is substantially rectangular.

* * * * *